US008234904B2

(12) United States Patent
Kerner et al.

(10) Patent No.: US 8,234,904 B2
(45) Date of Patent: Aug. 7, 2012

(54) CONTACT MAGAZINE LOADER FOR HAND HELD CRIMPER

(75) Inventors: Alex Kerner, Pacific Palisades, CA (US); Simon Schwartzman, Redondo Beach, CA (US)

(73) Assignee: Tri-Star Technologies, El Segundo, CA (US)

( * ) Notice: Subject to any disclaimer, the term of this patent is extended or adjusted under 35 U.S.C. 154(b) by 456 days.

(21) Appl. No.: 12/611,866

(22) Filed: Nov. 3, 2009

(65) Prior Publication Data

US 2010/0107721 A1 May 6, 2010

Related U.S. Application Data

(60) Provisional application No. 61/110,987, filed on Nov. 3, 2008.

(51) Int. Cl.
*H01R 43/045* (2006.01)
*B21D 7/06* (2006.01)

(52) U.S. Cl. ..... 72/409.04; 72/409.06; 72/409.14; 29/566.4; 29/751; 29/863; 206/313; 206/338; 206/413

(58) Field of Classification Search ..... 72/409.04, 72/409.06, 409.12, 409.14; 29/566.2, 566.4, 29/751, 863; 206/333, 413; 221/70, 71
See application file for complete search history.

(56) References Cited

U.S. PATENT DOCUMENTS

| | | | | |
|---|---|---|---|---|
| 2,812,676 | A | 11/1957 | Brown | |
| 3,094,717 | A * | 6/1963 | Gabbert | 72/409.04 |
| 3,167,107 | A * | 1/1965 | Ustin et al. | 29/816 |
| 4,022,051 | A * | 5/1977 | Ichikawa | 72/409.06 |
| 4,765,176 | A * | 8/1988 | Geisser | 72/409.04 |
| 4,784,262 | A | 11/1988 | Duddy et al. | |
| 4,953,384 | A | 9/1990 | Baillet et al. | |
| 5,307,553 | A * | 5/1994 | Frohlich | 29/566.2 |
| 5,347,705 | A * | 9/1994 | Schmode et al. | 29/566.4 |
| 5,500,998 | A | 3/1996 | Schmode et al. | |
| 6,315,118 | B1 | 11/2001 | Sauce | |
| 2002/0033039 | A1 | 3/2002 | Guatheret et al. | |

* cited by examiner

*Primary Examiner* — David Jones
(74) *Attorney, Agent, or Firm* — Lance M. Pritikin

(57) ABSTRACT

A contact magazine loader for guiding the insertion of individual electrical contacts into a crimping section of a crimping tool. A magazine is adapted to be placed in removable and rotatable engagement with a hand-held crimping tool. The magazine is approximately cylindrical, has a plurality of channels evenly dispersed around the radial periphery of the magazine, and is preloadable with electrical contacts. Each preloaded electrical contact is positioned within an individual insert casing. Each insert casing is adapted to being linearly slideably received into one of the channels. As a shuttle assembly is moved into compressed configuration, an insert casing guides the preloaded electrical contact into the crimping section of the hand-held crimper. A trigger assembly allows a user, with a single movement, to cause the shuttle assembly to return to its released configuration, and to rotate the magazine to axially align a subsequent casing with the crimping section of the hand held crimper.

20 Claims, 17 Drawing Sheets

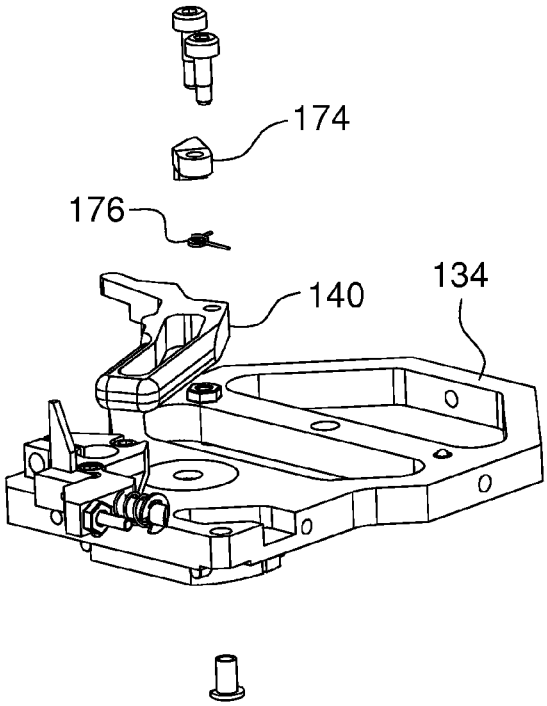
Fig. 28
Fig. 29
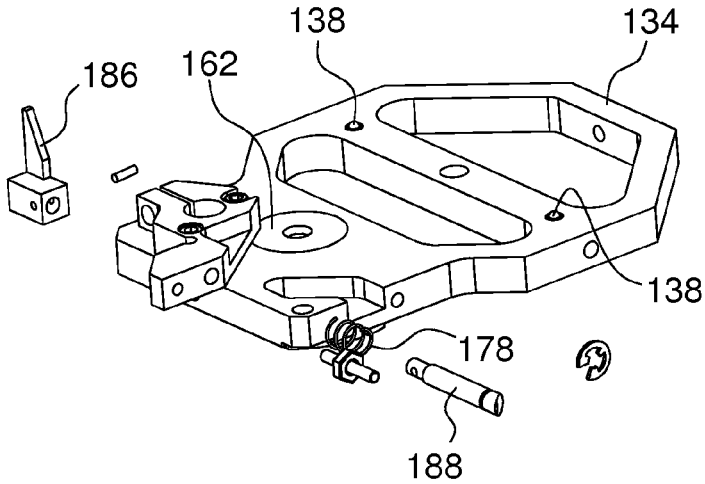

CONTACT MAGAZINE LOADER FOR HAND HELD CRIMPER

RELATED APPLICATIONS

This application claims the benefit of U.S. Provisional Application No. 61/110,987 filed Nov. 3, 2008, the content of all of which is incorporated by this reference in its entirety for all purposes as if fully set forth herein.

TECHNICAL FIELD OF THE INVENTION

The present invention relates generally to the field of hand held contact crimpers. More particularly, the invention concerns hand held contact crimpers which are magazine fed.

BACKGROUND OF THE INVENTION

Magazine fed crimpers are known. However, none of the current hand held contact crimpers appear to perform adequately in maximizing the speed, accuracy, reliability and versatility required for the crimping of contacts in mission critical equipment and applications such as rockets, airplanes, military equipment and the like. Development of a hand held crimper which can optimally crimp electrical contacts represents a significant improvement in the field of hand held contact crimpers, and satisfies a long felt need in this field. Further, those in the art have long recognized the need for an improved contact magazine loader which is attachable to a hand held crimper, and which is easily and conveniently reloadable.

SUMMARY OF THE INVENTION

By way of summary, embodiments concern a contact magazine loader for guiding the insertion of individual electrical contacts into a crimping section of a crimping tool. The contact magazine loader comprises a magazine which is rotatable, approximately cylindrical, and has a plurality of channels generally axially oriented and generally evenly dispersed around a radial periphery of the magazine. The magazine is preloadable with electrical contacts, wherein each such preloaded electrical contact is positioned within an insert casing. Each insert casing is adapted to being linearly slideably received in one of said channels.

In embodiments, the magazine generally includes a main axis and is adapted to be placed in removable and rotatable engagement with the crimping tool such that each of the channels are individually moveably into axial alignment with the crimping section by rotation of the magazine about the main axis. Typical embodiments further comprise a magazine base plate removably affixed to the crimping tool and disposed between the magazine and the crimping tool. In particular embodiments, the removable engagement is established between a detent groove in the magazine and one or more ball spring plungers positioned within the magazine base plate.

Particular embodiments further comprise a magazine base plate, a main base plate and a step detent interface therebetween. In such embodiments, the magazine is in removable engagement with magazine base plate such that the magazine base plate and the magazine are prevented from rotating with respect to each other. The main base plate is disposed between the magazine base plate and the crimping tool and the magazine base plate is rotatably attached to the main base plate. The step detent interface between the magazine base plate and the main base plate is for releasably biasing the magazine to remain at discrete rotational positions relative to the crimping tool. These rotational positions each place one of the channels into axial alignment with the crimping section of the crimping tool. The releasable bias may be provided by engagement between one or more of a plurality of radially dispersed detent holes in the magazine base and one or more ball spring plungers positioned within said main base plate, although the opposite arrangement may be used as well.

Certain embodiments further comprise a trigger assembly including a hand trigger element, a pulled configuration and a returned configuration. In such embodiments, the trigger assembly is operably associated with the magazine such that each time the trigger assembly is moved from its returned configuration to its pulled configuration, the magazine rotates to bring a subsequent one of the channels into axial alignment with the crimping section of the crimping tool.

Particular embodiments further comprise a shuttle assembly having a shuttle element, an insert hook, a released configuration and a compressed configuration. The insert hook has an engagement configuration and is operably aligned with the magazine such that each time the insert hook is in its engagement configuration and the shuttle assembly is moved toward its compressed configuration, the insert hook moves one of the insert casings axially toward the crimping section, thereby placing any respective preloaded electrical contact into the crimping section of the crimping tool. In embodiments, the insert hook may also have a lockback configuration. When the insert hook is placed in this lockback configuration, it is prevented from engaging one of the insert casings or inhibiting the axial movement of the magazine.

In embodiments which include a shuttle assembly, the shuttle assembly may be biased toward its released configuration. In such embodiments, the shuttle assembly may include a shuttle guide shaft and a shuttle lock. The shuttle lock has a locked configuration and an unlocked configuration, and may be biased toward its locked configuration such that the shuttle lock will releasably engage a lock detent within the shuttle guide shaft when the shuttle assembly is placed in its compressed configuration, thereby releasably restraining the shuttle assembly from returning to its released configuration.

Certain embodiments that include a shuttle assembly biased toward its locked configuration with a shuttle lock further comprise a shuttle return assembly. In such embodiments, the trigger assembly further includes an intermediate configuration operably disposed between its returned configuration and its pulled configuration. The shuttle return assembly is operably disposed between the trigger assembly and the shuttle assembly such that when the shuttle assembly is in its compressed configuration and the trigger assembly is moved to its intermediate configuration, the shuttle return assembly moves the shuttle lock from its locked configuration to its unlocked configuration, thereby allowing the shuttle assembly to return to its released configuration toward which it is biased.

Embodiments typically comprise a main base plate which is structurally disposed between the crimping tool and one or more of the magazine, trigger assembly, shuttle assembly and shuttle return assembly. Embodiments comprising a main base plate generally also comprise a base plate adaptor. The base plate adaptor is affixed to the main base plate, and is adapted to clampingly engage a position adaptor of the crimping tool, thereby removably affixing the contact magazine loader to the crimping tool.

Certain embodiments comprise a safety cover, typically removably affixed to the main base plate. The safety cover at least partially envelopes one or more of the trigger assembly, shuttle assembly, shuttle lock assembly and shuttle return assembly.

BRIEF DESCRIPTION OF THE DRAWINGS

Further advantages of the present invention may become apparent to those skilled in the art with the benefit of the following detailed description of the preferred embodiments and upon reference to the accompanying drawings in which:

FIG. 28 is a partially exploded perspective view showing, in part, elements of the trigger assembly of an embodiment of a contact magazine loader;

FIG. 29 is a partially exploded perspective view showing, in part, elements of the shuttle return assembly and main base plate of an embodiment of a contact magazine loader;

Figure 1:
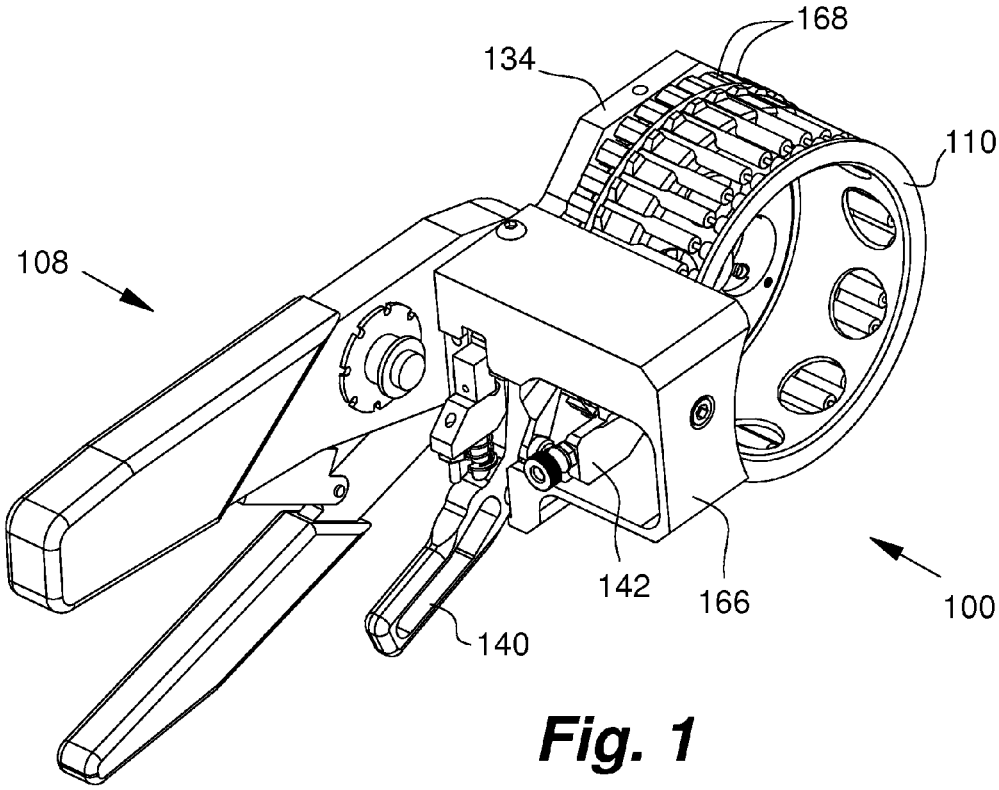
FIG. 1 is a perspective view of a contact magazine loader in accordance with the present invention shown removably affixed to a hand held crimping tool.
Figure 2:
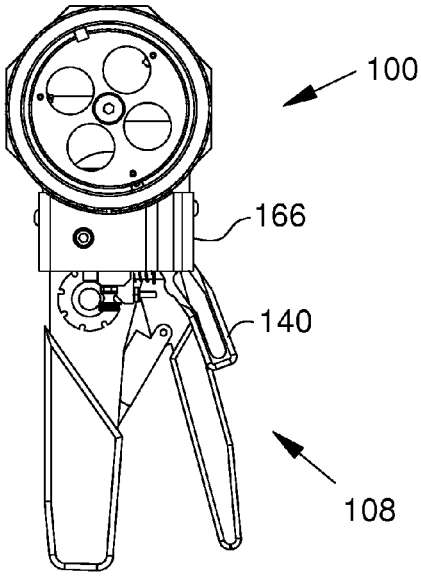
FIG. 2 is a top view of the embodiment shown in FIG. 1.
Figure 3:
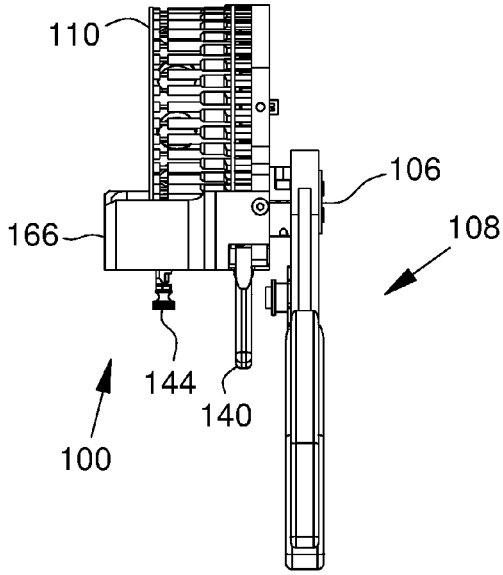
FIG. 3 is a side view of the embodiment shown in FIG. 1.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications.

DETAILED DESCRIPTION OF THE INVENTION

Referring now to the drawings, like reference numerals designate identical or corresponding features throughout the several views.

Figure 30:
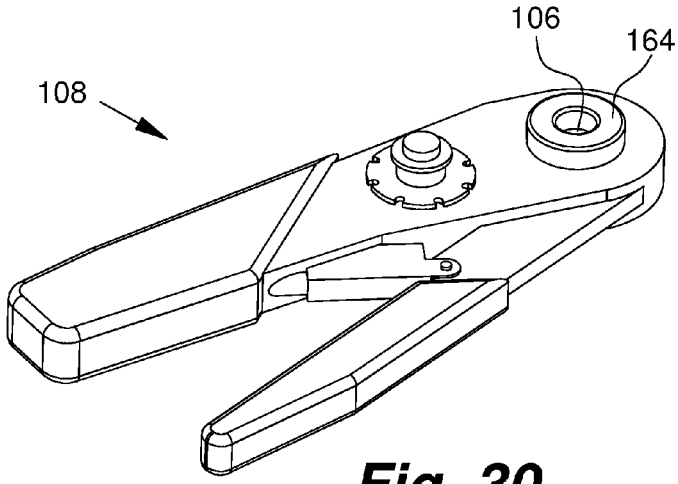
FIG. 30 is a perspective view of a hand held crimper including its position adaptor.
Figure 31:
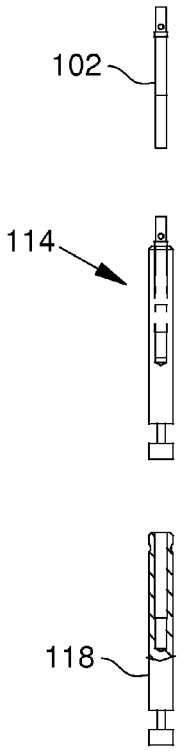
FIG. 31 depicts a side view of a first type of electrical contact, a partial sectional view of an insert casing adapted to receive this first type of electrical contact, and a transparent side view showing the first type of electrical contact positioned within the insert casing.
Figure 32:
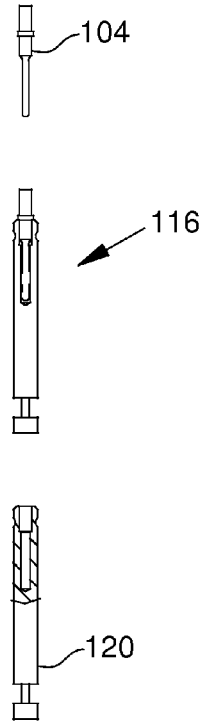
FIG. 32 depicts a side view of a second type of electrical contact, a partial sectional view of an insert casing adapted to receive this second type of electrical contact, and a transparent side view showing the second type of electrical contact positioned within the insert casing.
Figure 33:
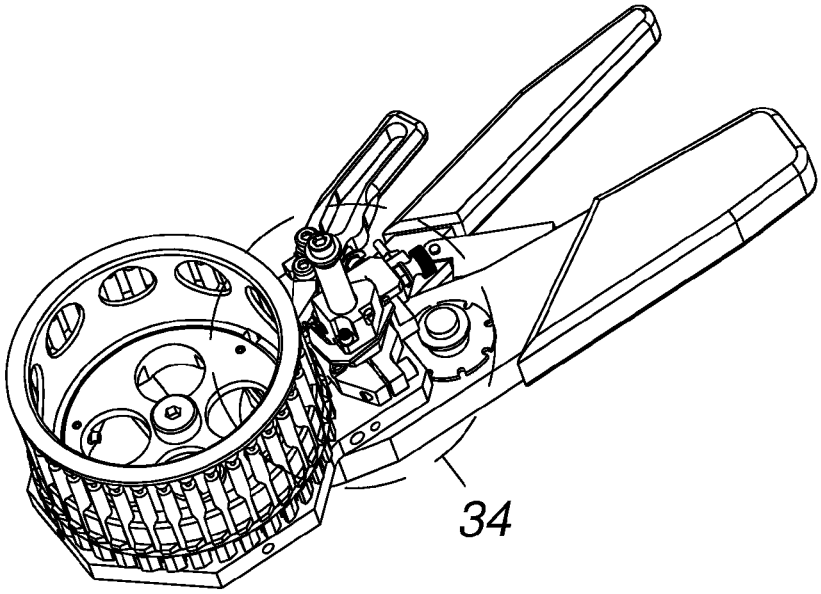
FIG. 33 is a further perspective view of an embodiment of a contact magazine loader removably affixed to a hand held crimper, with the safety cover removed.

Throughout the several drawings, one embodiment of a contact magazine loader is shown generally at 100, and a hand held crimping tool is shown generally at 108. Turning to FIG. 1, a contact magazine loader 100 is for guiding the insertion of individual electrical contacts (as shown, for example, at 102 and 104 in FIGS. 8, 31 and 32) into a crimping section 106 (see FIGS. 4 and 30) of a crimping tool 108. The specific form of electrical contact is not limited to those shown at 102 and 104. The contact magazine loader 100 comprises a magazine 110, which is rotatable, approximately cylindrical, and has a plurality of channels 112 (see FIG. 8) being generally axially oriented and generally evenly dispersed around a radial periphery of the magazine 110. Magazine 110 also includes a multiplicity of magazine teeth 168 generally evenly distributed around its outer radial periphery. There are typically the same number of teeth 168 as there are channels 112. Turning now to FIGS. 8-10, 31 and 32, the magazine 110 is preloadable with electrical contacts (as shown, for example, at 102 and 104), wherein each such preloaded electrical contact is positioned within an insert casing 120 adapted to being linearly slideably received in one of the channels 112. An O-ring 196 may be positioned within generally the outer periphery of the magazine 110 such that the O-ring 196 is in frictional engagement with each insert casing 120 that is linearly slideably received in one of the channels 112.

Figure 6:
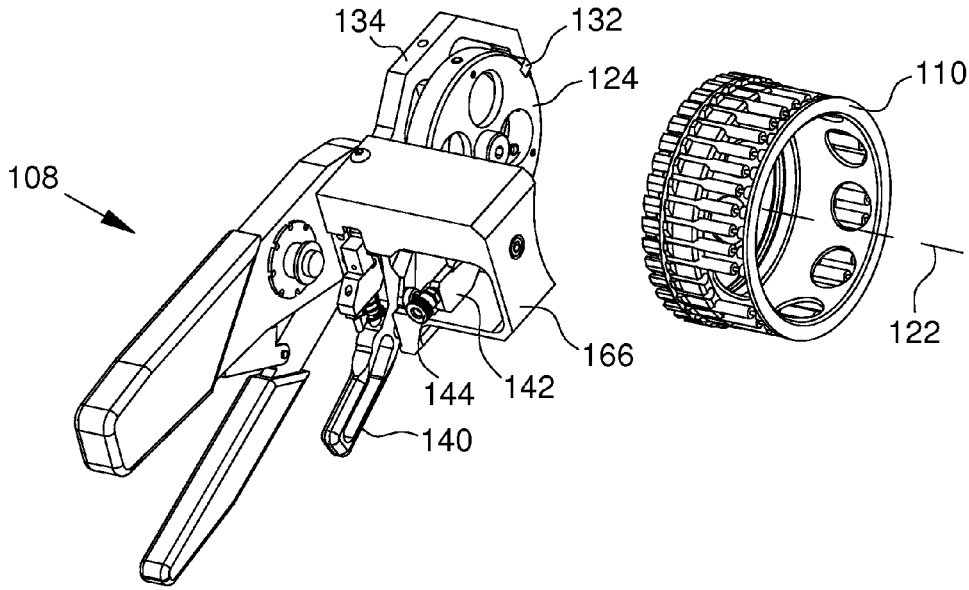
FIG. 6 is a perspective view of a contact magazine loader removably affixed to a hand held crimper, but with the magazine removed from engagement with the magazine base plate.
Figure 7:
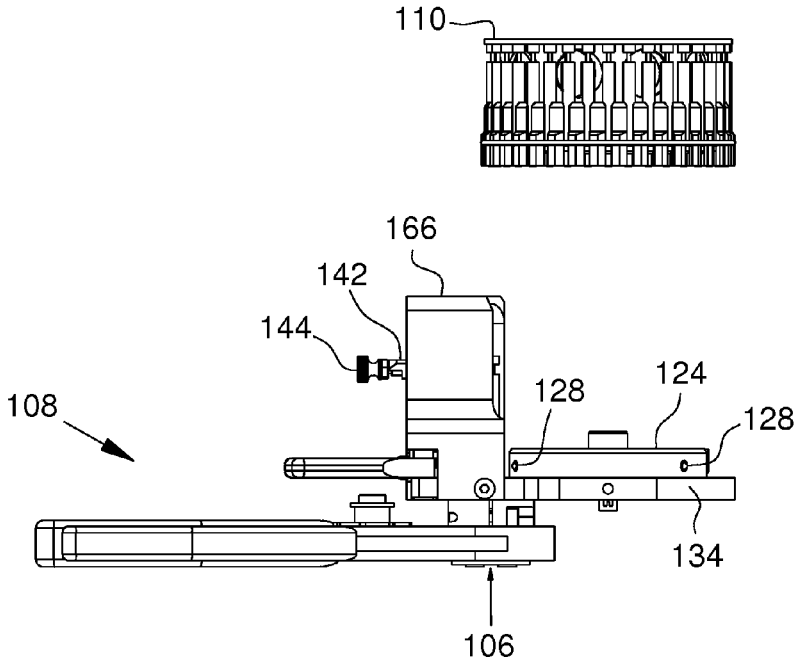
FIG. 7 is a side view of the arrangement shown in FIG. 6.
Figure 8:
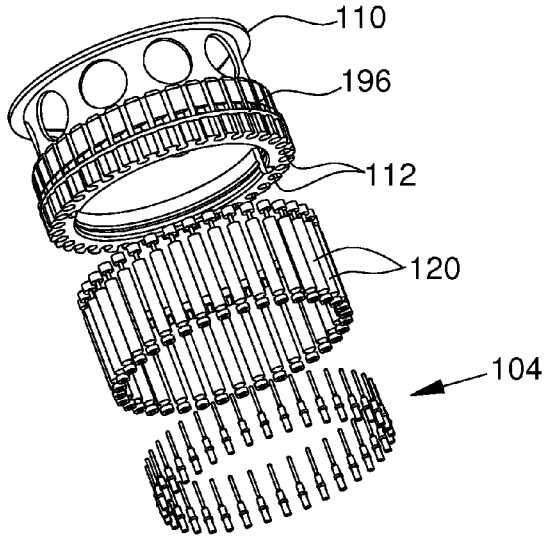
FIG. 8 is an exploded perspective view showing electrical contacts and insert casings respectively aligned with the plurality of channels of a magazine.
Figure 9:
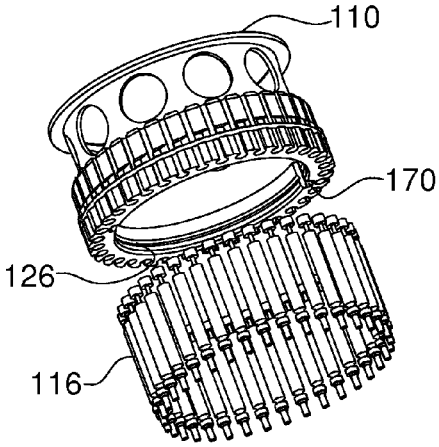
FIG. 9 is an exploded perspective view similar to that of FIG. 8, but in which each electrical contact has been positioned within a respective insert casing.
Figure 10:
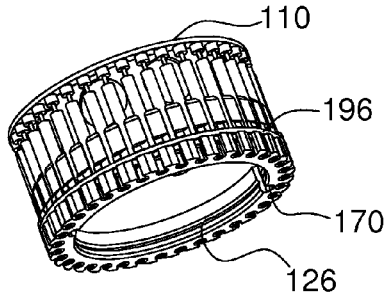
FIG. 10 is a perspective view showing a magazine in which each insert casing includes a preloaded electrical contact and has been slideably received within a respective channel of the magazine.
Figure 26:
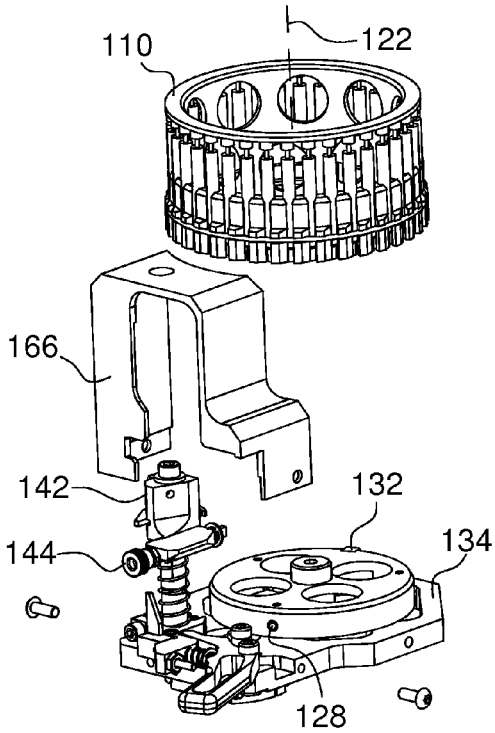
FIG. 26 is a partially exploded perspective view showing, in part, elements of the magazine and safety cover of embodiment of a contact magazine loader.

Turning to FIGS. 6 and 26, the magazine 110 includes a main axis 122 and is adapted to be placed in removable and rotatable engagement with the crimping tool 108 such that each of the channels 112 (see FIG. 8) are individually moveably into axial alignment with the crimping section 106 by rotation of the magazine 110 about the main axis 122. A magazine base plate 124 is removably affixed to the crimping tool 108 and disposed between the magazine 110 and the crimping tool 108. The removable engagement may be established between a detent groove 126 (see FIG. 9) in the magazine 110 and one or more ball spring plungers 128 (see, for example, FIG. 27) positioned within the magazine base plate 124 and held in place, in part, by set screws 130. The magazine 110 is placed in removable engagement with magazine base plate 124 such that the magazine base plate 124 and magazine 110 are prevented from rotating with respect to each other, generally by way of engagement between key slot 170 (see, for example, FIG. 9) and a magazine key 132 (see, for example, FIGS. 26 and 27).

A main base plate 134 is typically disposed between the magazine base plate 124 and the crimping tool 108. The magazine base plate 124 is rotatably attached to the main base plate 134, generally by way of a bolt 172 (see, for example, FIG. 27). A step detent interface exists between the magazine base plate 124 and the main base plate 134 for releasably biasing the magazine 110 to remain at discrete rotational positions. Each rotational position places one of the channels 112 into axial alignment with the crimping section 106. The releasable bias is provided by engagement between one or more of a plurality of radially dispersed detent holes such as is shown at 136 (see, for example, FIG. 4) in the magazine base plate 124 and one or more ball spring plungers 138 (see, for example, FIG. 27) positioned within the main base plate 134.

Figure 11:
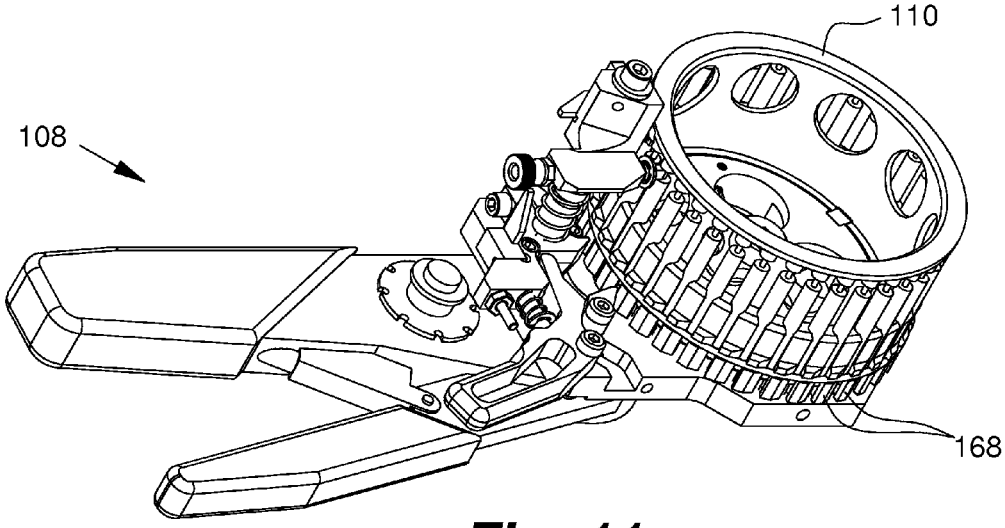
FIG. 11 is a perspective view of a contact magazine loader removably affixed to a hand held crimper, with the safety cover removed, and showing the trigger assembly in its returned configuration and the shuttle assembly in its released configuration.
Figure 12:
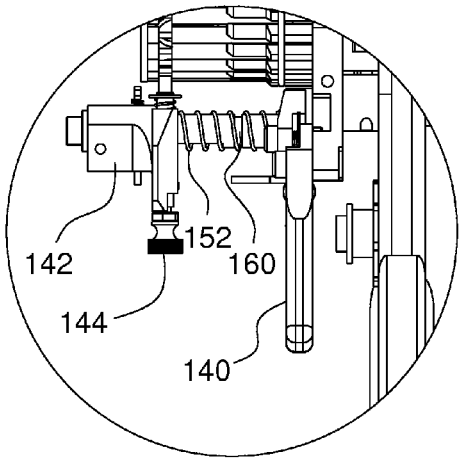
FIG. 12 is an enlarged partial side view of the embodiment and configurations shown in FIG. 11.
Figure 13:
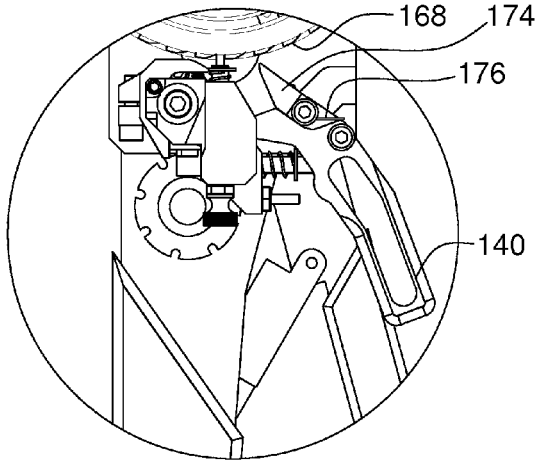
FIG. 13 is an enlarged partial top view of the embodiment and configurations shown in FIG. 11.
Figure 20:
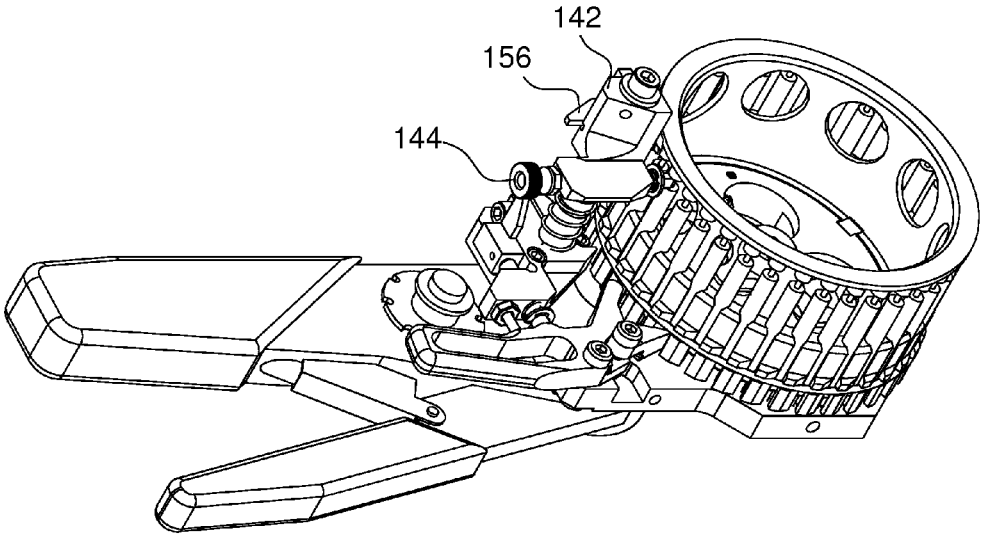
FIG. 20 is a perspective view of a contact magazine loader and hand held crimper similar to that of FIG. 17, but in which the shuttle assembly has returned to its released configuration and the trigger assembly has been moved to its pulled configuration, causing the magazine to rotate enough to bring a subsequent one of its channels into axial alignment with the crimping section of a hand held crimping tool.
Figure 21:
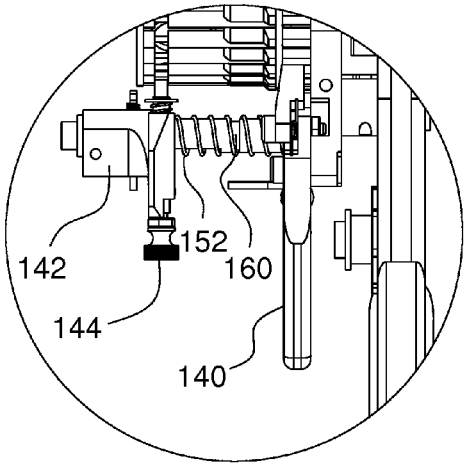
FIG. 21 is an enlarged partial side view of the embodiment and configurations shown in FIG. 20.
Figure 22:
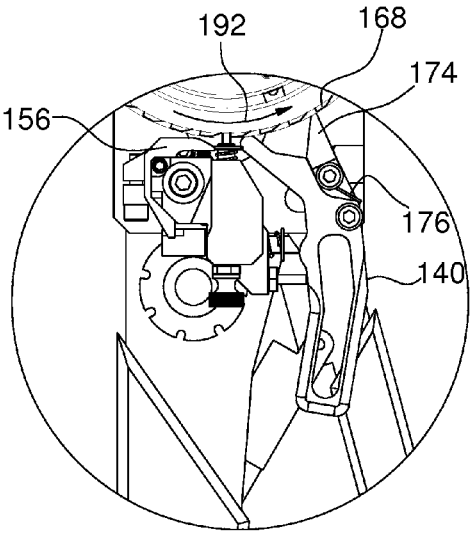
FIG. 22 is an enlarged partial top view of the embodiment and configurations shown in FIG. 20.
Figure 23:
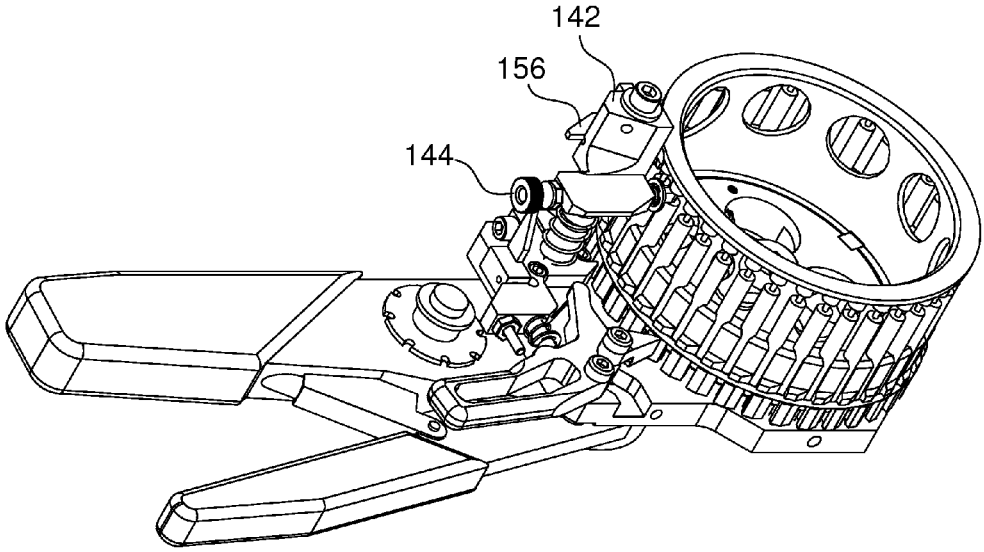
FIG. 23 is a perspective view of a contact magazine loader and hand held crimper similar to that of FIG. 20, but in which the trigger assembly is returning to its returned configuration and a magazine tooth is causing the unidirectional catch to yield as it passes.
Figure 24:
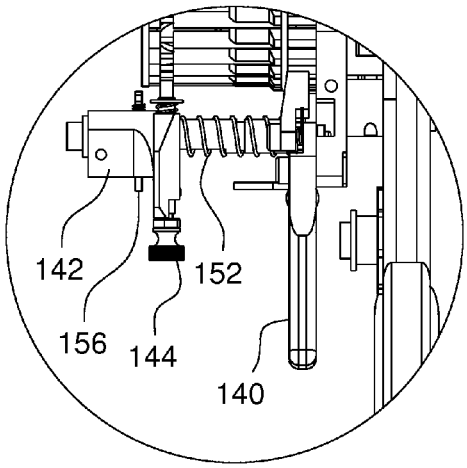
FIG. 24 is an enlarged partial side view of the embodiment and configurations shown in FIG. 23.
Figure 25:
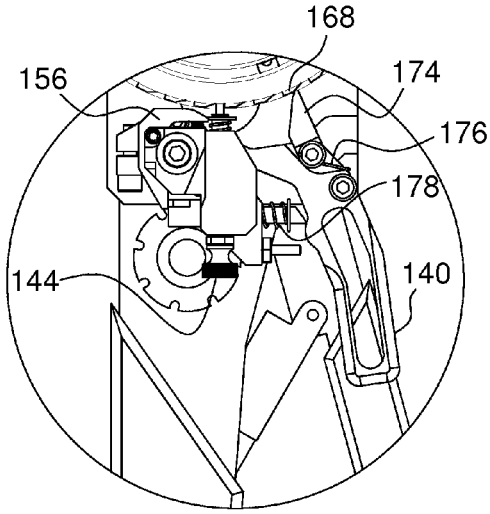
FIG. 25 is an enlarged partial top view of the embodiment and configurations shown in FIG. 23.

Turning now to FIG. 28, a trigger assembly includes a hand trigger element 140, a unidirectional catch 174, a torsion spring 176 a pulled configuration (depicted, for example, in FIGS. 20-22) and a returned configuration (depicted, for example, in FIGS. 11-13). The trigger assembly is operably associated with the magazine 110 such that each time the trigger assembly is moved from its returned configuration to its pulled configuration, the magazine 110 rotates to bring a subsequent one of the channels 112 into axial alignment with the crimping section 106. This is accomplished by unidirectional catch 174 engaging a magazine tooth 168, thereby forcing the magazine to rotate to its next rotational position. As shown, for example, in FIGS. 23-25, when the trigger assembly is allowed to travel back to its returned configuration under the force of compression spring 178, unidirectional catch 174 yields to the magazine tooth it previously engaged, acting against the bias of torsion spring 176 to do so.

Figure 14:
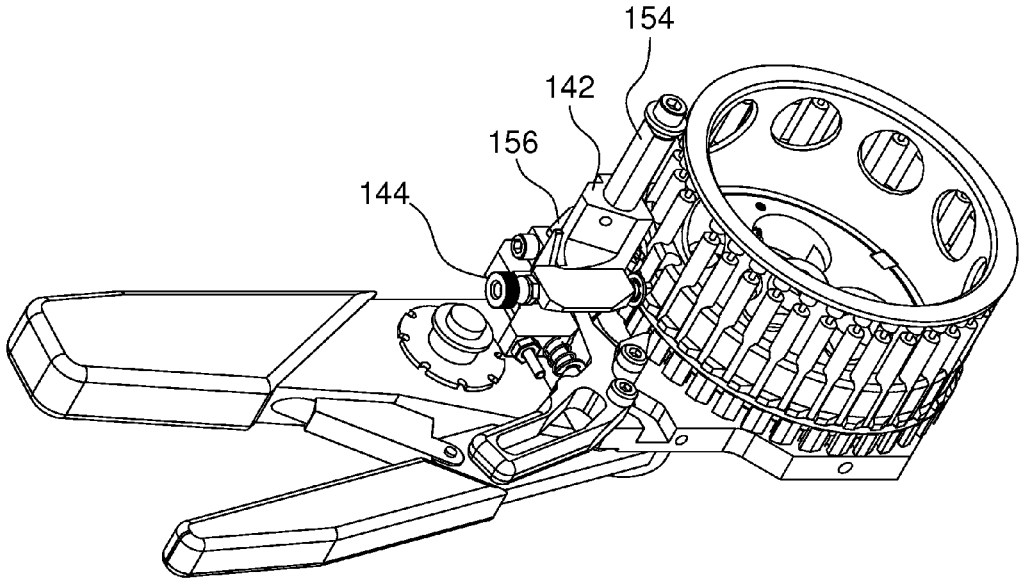
FIG. 14 is a perspective view of a contact magazine loader and hand held crimper similar to that of FIG. 11, but in which the shuttle assembly in its compressed configuration and the shuttle lock is in its locked configuration.
Figure 15:
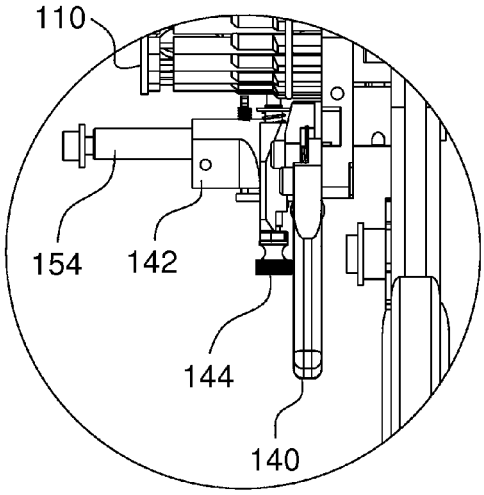
FIG. 15 is an enlarged partial side view of the embodiment and configurations shown in FIG. 14.
Figure 16:
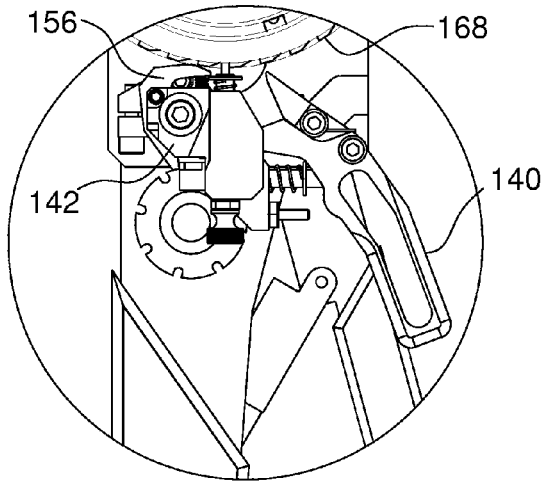
FIG. 16 is an enlarged partial top view of the embodiment and configurations shown in FIG. 14.

A shuttle assembly has a shuttle element 142, an insert hook 144, a released configuration (shown, for example, in FIGS. 11-13) and a compressed configuration (shown, for example, in FIGS. 14-16). The insert hook 144 is biased toward an engagement configuration by way of compression spring 180 (see FIGS. 35-38 to see the engagement configuration in more detail), and is operably aligned with the magazine 110 such that each time the insert hook 144 is in its engagement configuration and the shuttle assembly is moved toward its compressed configuration, the insert hook 144 moves one of the insert casings 118, 120 axially toward the crimping section 106, thereby placing any respective said preloaded electrical contact 102, 104 into the crimping section 106 (this arrangement is shown, for example, in FIGS. 14-16). The shuttle assembly is biased toward its released configuration, typically by a compression spring 152 (see FIG. 27).

Turning now to FIGS. 39-42, the insert hook further has a lockback configuration. This lockback configuration is achieved by pulling the insert hook in the rearward direction 146 against the bias of compression spring 180, rotating it in a counterclockwise direction 148, and releasing it so that axial catch 182 engages a detent face 184 of shuttle element. Insert hook 144 may be returned to engagement configuration (shown, for example, in FIGS. 35-38) simply by turning it in a clockwise direction and releasing it. As shown in FIGS. 39-42, when in lockback configuration, the insert hook 144 is prevented from engaging one of the insert casings (such as those shown at 118 and 120 in FIGS. 31 and 32) or inhibiting the axial movement of the magazine 110. A user generally places the insert hook in lockback configuration to aid in the removal and reattachment of magazine 110.

Figure 27:
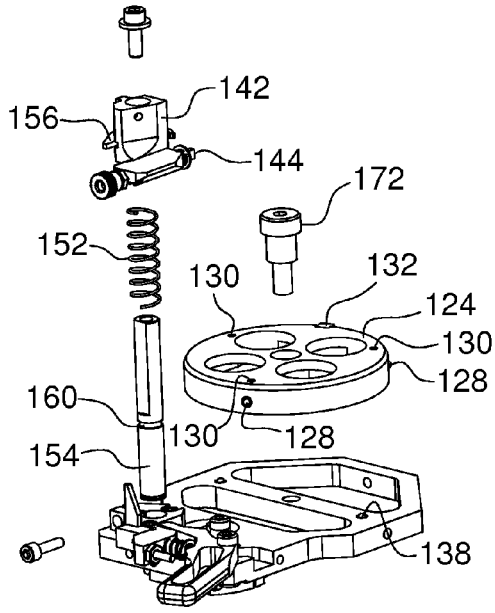
FIG. 27 is a partially exploded perspective view showing, in part, elements of the shuttle assembly and magazine base plate of an embodiment of a contact magazine loader.
Figure 34:
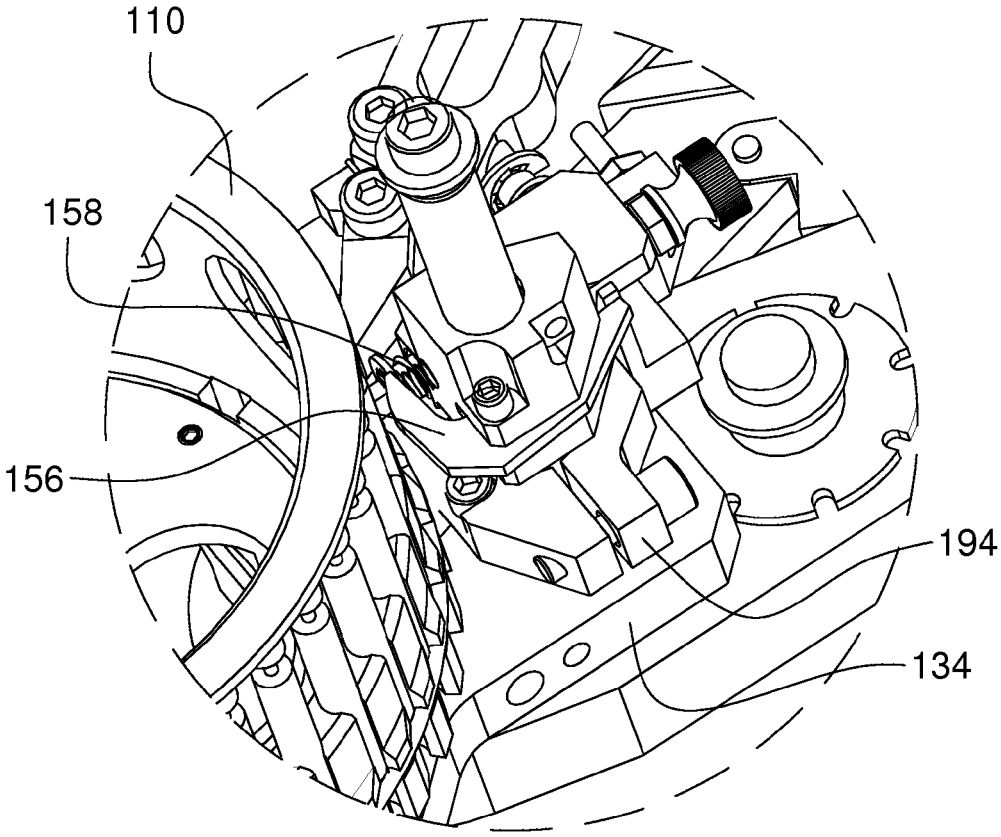
FIG. 34 is an enlarged partial view of detail 34 of FIG. 33, showing in greater detail the shuttle assembly in compressed configuration and the shuttle lock in locked configuration.
Figure 35:
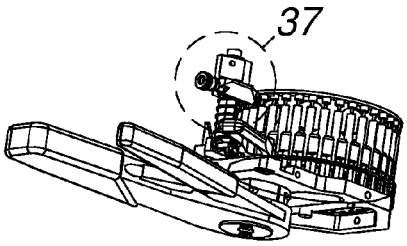
FIG. 35 is a further perspective view of an embodiment of a contact magazine loader removably affixed to a hand held crimper, with the safety cover removed.
Figure 36:
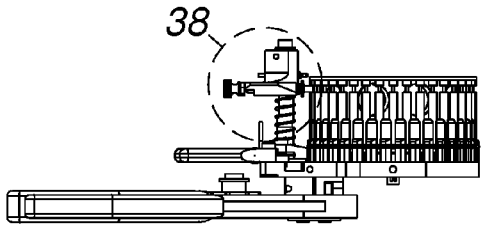
FIG. 36 is a side view of the embodiment and configurations shown in FIG. 35.
Figure 37:
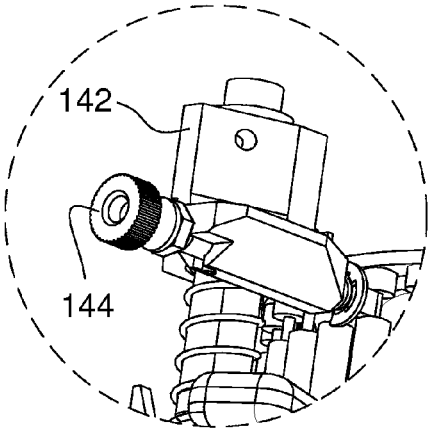
FIG. 37 is an enlarge partial view of detail 37 of FIG. 35, showing the insert hook in engagement configuration.
Figure 38:
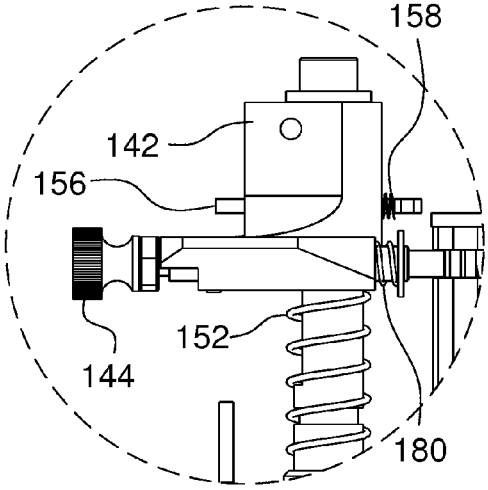
FIG. 38 is an enlarge partial view of detail 38 of FIG. 36, also showing the insert hook in engagement configuration.
Figure 39:
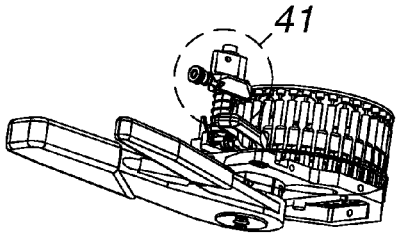
FIG. 39 is a further perspective view of an embodiment of a contact magazine loader removably affixed to a hand held crimper, with the safety cover removed.
Figure 40:
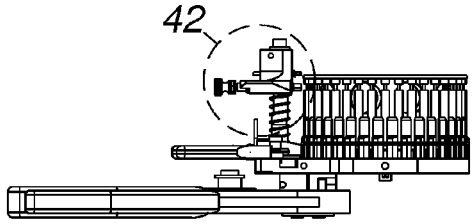
FIG. 40 is a side view of the embodiment and configurations shown in FIG. 39.
Figure 41:
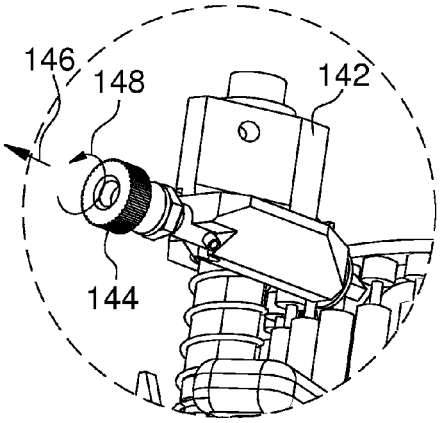
FIG. 41 is an enlarge partial view of detail 41 of FIG. 39, showing the insert hook in lockback configuration.
Figure 42:
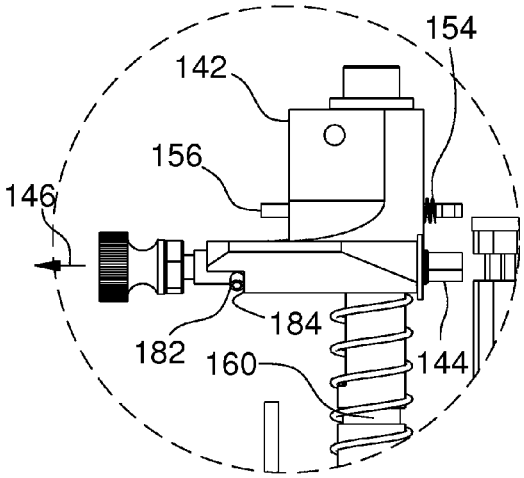
FIG. 42 is an enlarge partial view of detail 42 of FIG. 40, also showing the insert hook in lockback configuration.
Figure 43:
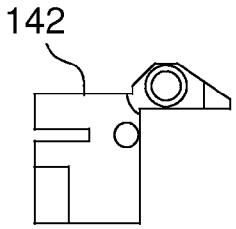
FIG. 43 is a front view of a shuttle element of a contact magazine loader in accordance with the present invention.
Figure 44:
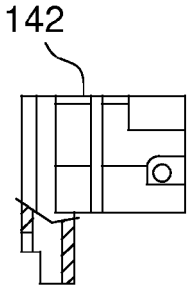
FIG. 44 is a side view of the shuttle element shown in FIG. 43 shown in partial cross-section.
Figure 45:
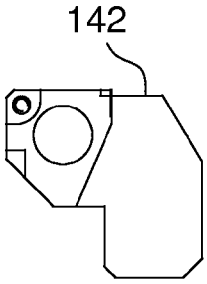
FIG. 45 is a top view of the shuttle element shown in FIG. 43.
Figure 46:
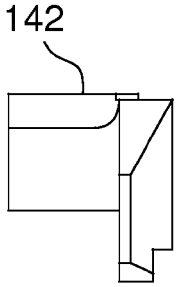
FIG. 46 is a further side view of the shuttle element shown in FIG. 43.
Figure 47:
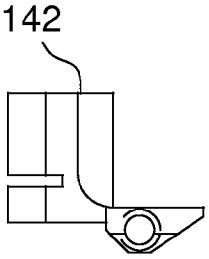
FIG. 47 is a rear view of the shuttle element shown in FIG. 43.
Figure 48:
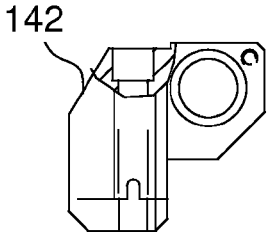
FIG. 48 is a bottom view of the shuttle element shown in FIG. 43.
Figure 49:
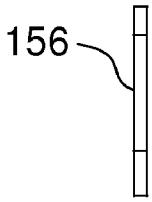
FIG. 49 is a side view of a shuttle lock of a contact magazine loader in accordance with the present invention.
Figure 50:
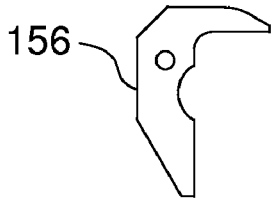
FIG. 50 is a top view of the shuttle lock shown in FIG. 49.
Figure 51:
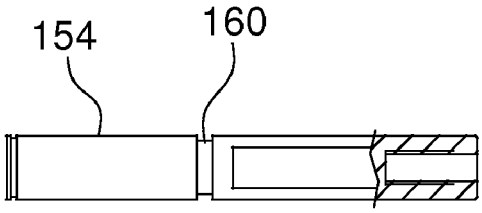
FIG. 51 is a side view of a shuttle guide shaft of a contact magazine loader in accordance with the present invention, shown in partial cross-section.
Figure 52:
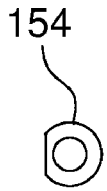
FIG. 52 is a top view of the shuttle guide shaft shown in FIG. 51.
Figure 53:
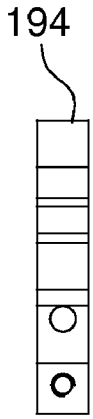
FIG. 53 is a side view of a shuttle base plate of a contact magazine loader in accordance with the present invention.
Figure 54:
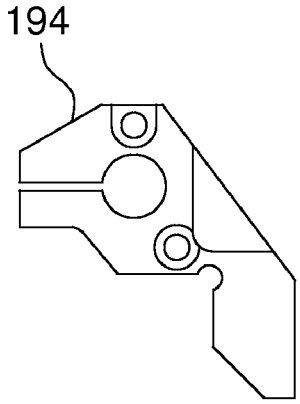
FIG. 54 is a top view of the shuttle guide shaft shown in FIG. 53.
Figure 55:
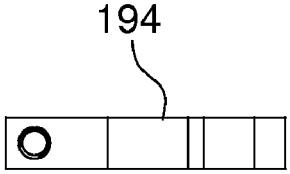
FIG. 55 is a further side view of the shuttle guide shaft shown in FIG. 53.

Turning to FIG. 27, the shuttle assembly includes a shuttle guide shaft 154 and a shuttle lock 156 (see also, FIG. 50). The shuttle guide shaft 154 is held in place, at least in part, by a shuttle base plate 194 (see FIGS. 29 and 53-55). The shuttle lock 156 has a locked configuration (shown, for example, in FIGS. 14-16) and an unlocked configuration (see FIGS. 17-19). The shuttle lock 156 is biased toward its locked configuration, typically by a compression spring 158 (see FIGS. 34 and 38), such that the shuttle lock 156 will releasably engage a lock detent 160 (see FIGS. 27 and 51) within the shuttle guide shaft 154 when the shuttle assembly is placed in its compressed configuration, thereby releasably restraining the shuttle assembly from returning to said released configuration (see FIGS. 14-16) under the bias of compression spring 152.

Figure 17:
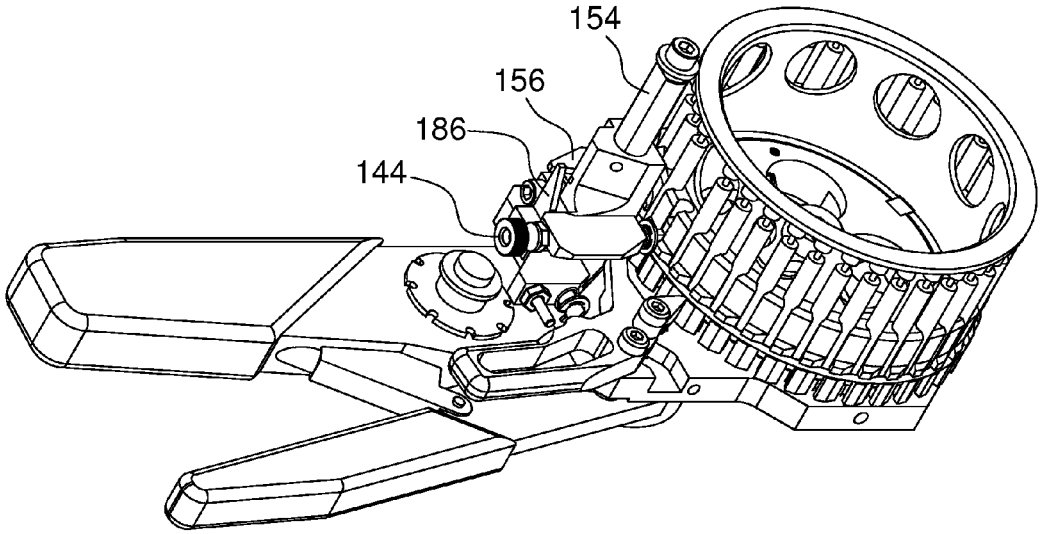
FIG. 17 is a perspective view of a contact magazine loader and hand held crimper similar to that of FIG. 14, but in which the trigger assembly has been moved to its intermediate configuration, causing the shuttle return assembly to move the shuttle lock to its unlocked configuration, thereby allowing the shuttle assembly to return to the released configuration to which it is biased.
Figure 18:
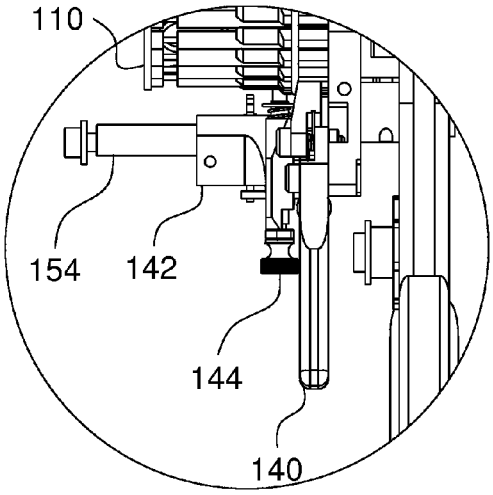
FIG. 18 is an enlarged partial side view of the embodiment and configurations shown in FIG. 17.
Figure 19:
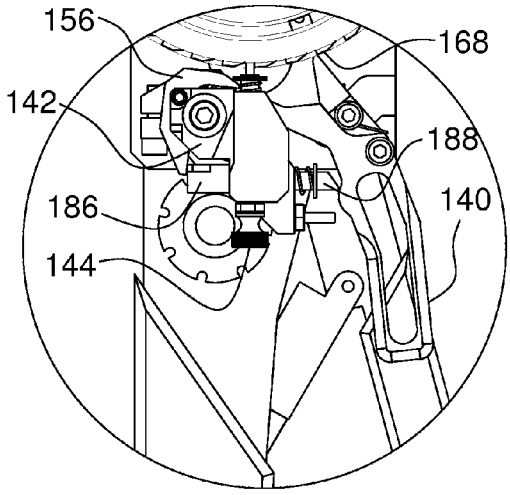
FIG. 19 is an enlarged partial top view of the embodiment and configurations shown in FIG. 17.

As shown in FIGS. 17-19, the trigger assembly may further include an intermediate configuration operably disposed between its returned configuration and its pulled configuration. A shuttle return assembly has a shuttle return hook 186 and a shuttle return shaft 188 (see FIG. 29), and is operably disposed between the trigger assembly and the shuttle assembly such that, as shown in FIGS. 17-19, when the shuttle assembly is in its compressed configuration and the trigger assembly is moved to its intermediate configuration, the shuttle return assembly moves the shuttle lock 156 from its locked configuration to its unlocked configuration, thereby allowing the shuttle assembly to return to its released configuration prior to the magazine being rotated. The magazine is only rotated once the trigger assembly is moved from its intermediate configuration to its pulled configuration (shown in FIGS. 20-22), as a result of the unidirectional catch 174 unyieldingly engaging a subsequent magazine tooth 168. The direction of the magazine's rotation is shown at 192 in FIG. 22.

Figure 4:
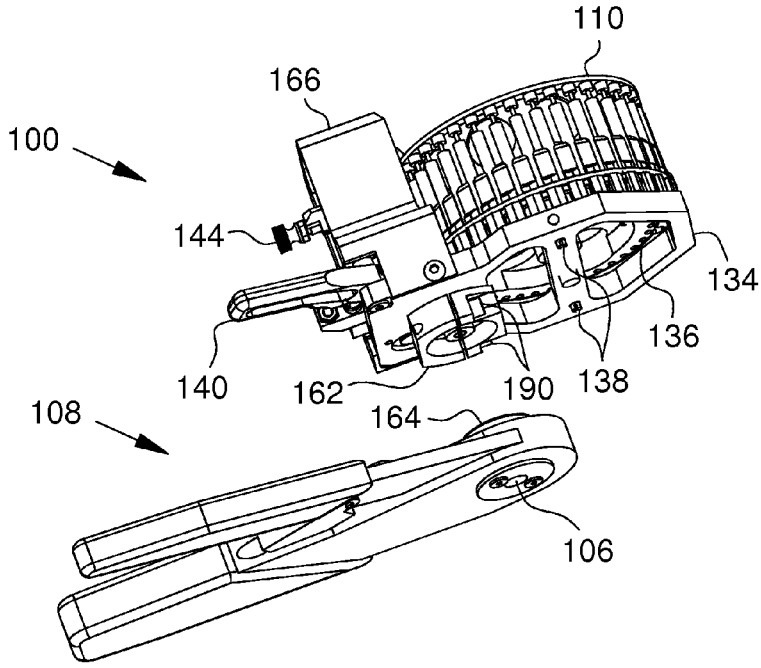
FIG. 4 is a perspective view of a contact magazine loader shown removed from a hand held crimping tool to which it is adapted to be removably affixed.
Figure 5:
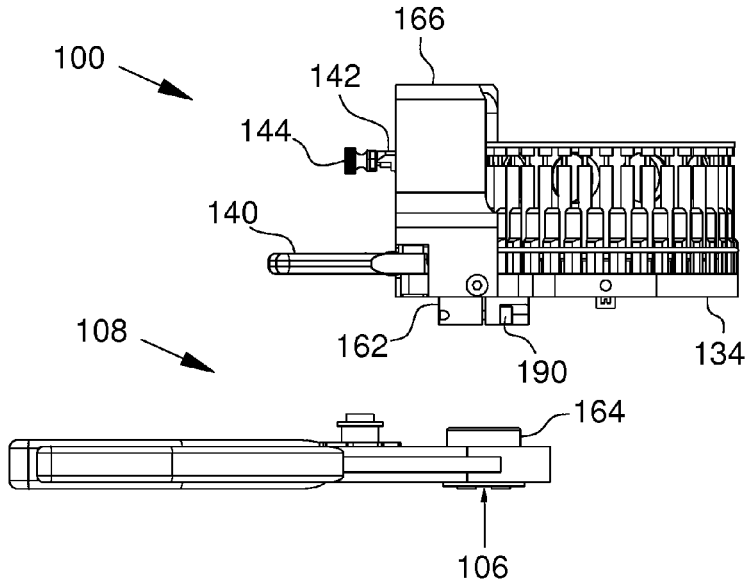
FIG. 5 is a side view of the arrangement shown in FIG. 4.

A main base plate 134 is structurally disposed between the crimping tool 108 and each of the magazine 110, trigger assembly, shuttle assembly and shuttle return assembly. Turning to FIGS. 4 and 5, a base plate adaptor 162 is affixed to the main base plate 134 and is adapted to clampingly engage a position adaptor 164 of the crimping tool 108, typically by way of one or more hex bolts 190, thereby removably affixing the contact magazine loader 100 to the crimping tool 108. A safety cover 166 is removably affixed to the main base plate 134. The safety cover 166 at least partially envelopes the trigger assembly, shuttle assembly, shuttle lock assembly and shuttle return assembly.

The detailed description of embodiments of the contact magazine loader is intended to serve merely as examples, and is in no way intended to limit the scope of the appended claims to these described embodiments. Accordingly, modifications to the embodiments described are possible, and it should be clearly understood that the invention may be practiced in many different ways than the embodiments specifically described below, and still remain within the scope of the claims.

The invention claimed is:

1. A contact magazine loader for guiding the insertion of individual electrical contacts into a crimping section of a crimping tool, said contact magazine loader comprising a magazine, said magazine being rotatable, approximately cylindrical, and having a plurality of channels being generally axially oriented and generally evenly dispersed around a radial periphery of said magazine, said magazine being preloadable with electrical contacts, wherein each such preloaded electrical contact is positioned within an insert casing, each said insert casing being adapted to being linearly slideably received in one of said channels.

2. A contact magazine loader as defined in claim 1 in which said magazine includes a main axis and is adapted to be placed in removable and rotatable engagement with said crimping tool such that each of said channels are individually moveably into axial alignment with said crimping section by rotation of said magazine about said main axis.

3. A contact magazine loader as defined in claim 2 further comprising a magazine base plate removably affixed to said crimping tool and disposed between said magazine and said crimping tool, said removable engagement being established between a detent groove in said magazine and one or more ball spring plungers positioned within said magazine base plate.

4. A contact magazine loader as defined in claim 2 further comprising:

(a) a magazine base plate with which said magazine is in removable engagement such that said magazine base plate and said magazine are prevented from rotating with respect to each other;

(b) a main base plate disposed between said magazine base plate and said crimping tool, said magazine base plate being rotatably attached to said main base plate; and (c) a step detent interface between said magazine base plate and said main base plate for releasably biasing said magazine to remain at discrete rotational positions, said rotational positions each placing one of said channels into axial alignment with said crimping section.

5. A contact magazine loader as defined in claim 4 in which said releasable bias is provided by engagement between one or more of a plurality of radially dispersed detent holes in said magazine base and one or more ball spring plungers positioned within said main base plate.

6. A contact magazine loader as defined in claim 1 further comprising a trigger assembly including a hand trigger element, a pulled configuration and a returned configuration, said trigger assembly being operably associated with said magazine such that each time said trigger assembly is moved from said returned configuration to said pulled configuration, said magazine rotates to bring a subsequent one of said channels into axial alignment with said crimping section.

7. A contact magazine loader as defined in claim 6 further comprising a shuttle assembly having a shuttle element, an insert hook, a released configuration and a compressed configuration, said insert hook having an engagement configuration and being operably aligned with said magazine such that each time said insert hook is in said engagement configuration and said shuttle assembly is moved toward said compressed configuration, said insert hook moves one of said insert casings axially toward said crimping section, thereby placing any respective said preloaded electrical contact into said crimping section.

8. A contact magazine loader as defined in claim 7 in which said insert hook further has a lockback configuration, said insert hook being prevented from engaging one of said insert casings or inhibiting the axial movement of said magazine when in said lockback configuration.

9. A contact magazine loader as defined in claim 7 in which said shuttle assembly is biased toward said released configuration.

10. A contact magazine loader as defined in claim 9 in which said shuttle assembly includes a shuttle guide shaft and a shuttle lock, said shuttle lock having a locked configuration and an unlocked configuration, said shuttle lock being biased toward said locked configuration such that said shuttle lock will releasably engage a lock detent within said shuttle guide shaft when said shuttle assembly is placed in said compressed configuration, thereby releasably restraining said shuttle assembly from returning to said released configuration.

11. A contact magazine loader as defined in claim 10 in which:

(a) said trigger assembly further includes an intermediate configuration operably disposed between said returned configuration and said pulled configuration; and (b) said contact magazine loader further comprises a shuttle return assembly, said shuttle return assembly being operably disposed between said trigger assembly and said shuttle assembly such that when said shuttle assembly is in said compressed configuration and said trigger assembly is moved to said intermediate configuration, said shuttle return assembly moves said shuttle lock from said locked configuration to said unlocked configuration, thereby allowing said shuttle assembly to return to said released configuration.

12. A contact magazine loader as defined in claim 11 further comprising a main base plate being structurally disposed between said crimping tool and each of said magazine, trigger assembly, shuttle assembly and shuttle return assembly.

13. A contact magazine loader as defined in claim 12 further comprising a base plate adaptor, said base plate adaptor being affixed to said main base plate and being adapted to clampingly engage a position adaptor of said crimping tool, thereby removably affixing said contact magazine loader to said crimping tool.

14. A contact magazine loader as defined in claim 12 further comprising a safety cover removably affixed to said main base plate, said safety cover at least partially enveloping said trigger assembly, shuttle assembly, shuttle lock assembly and shuttle return assembly.

15. A contact magazine loader for guiding the insertion of individual electrical contacts into a crimping section of a crimping tool, said contact magazine loader comprising:

(a) a magazine, said magazine being approximately cylindrical, and having a main axis and a plurality of channels being generally axially oriented and generally evenly dispersed around a radial periphery of said magazine, said magazine being adapted to be:

(i) placed in removable and rotatable engagement with said crimping tool such that each of said channels are individually moveably into axial alignment with said crimping section by rotation of said magazine about said main axis; and (ii) preloadable with electrical contacts, wherein each such preloaded electrical contact is positioned within an insert casing, each said insert casing being adapted to being linearly slideably received in one of said channels; and (b) a trigger assembly including a hand trigger element, a pulled configuration and a returned configuration, said trigger assembly being operably associated with said magazine such that each time said trigger assembly is moved from said returned configuration to said pulled configuration, said magazine rotates to bring a subsequent one of said channels into axial alignment with said crimping section; and (c) a shuttle assembly having a shuttle element, an insert hook, a released configuration and a compressed configuration, said insert hook having an engagement configuration and being operably aligned with said magazine such that each time said insert hook is in said engagement configuration and said shuttle assembly is moved toward said compressed configuration, said insert hook moves one of said insert casings axially toward said crimping section, thereby placing any respective said preloaded electrical contact into said crimping section.

16. A contact magazine loader as defined in claim 15 in which said insert hook further has a lockback configuration, said insert hook being prevented from engaging one of said insert casings or inhibiting the axial movement of said magazine when in said lockback configuration.

17. A contact magazine loader as defined in claim 15 in which in which:

(a) said shuttle assembly is biased toward said released configuration, and includes:

(i) a shuttle guide shaft with a lock detent; and (ii) a shuttle lock having a locked configuration and an unlocked configuration, said shuttle lock being springingly biased toward said locked configuration such that said shuttle lock will releasably engage said lock detent when said shuttle assembly is placed in said compressed configuration, thereby releasably restraining said shuttle assembly from returning to said released configuration; and (b) said trigger assembly further includes an intermediate configuration operably disposed between said returned configuration and said pulled configuration; and (c) said contact magazine loader further comprises a shuttle return assembly, said shuttle return assembly being operably disposed between said trigger assembly and said shuttle assembly such that when said shuttle assembly is in said compressed configuration and said trigger assembly is moved to said intermediate configuration, said shuttle return assembly moves said shuttle lock from said locked configuration to said unlocked configuration, thereby allowing said shuttle assembly to return to said released configuration.

18. A contact magazine loader as defined in claim 17 further comprising:

(a) a main base plate disposed between said crimping tool and each of said magazine, trigger assembly, shuttle assembly and shuttle return assembly;

(b) a base plate adaptor being affixed to said main base plate and being adapted to clampingly engage a position adaptor of said crimping tool, thereby removably affixing said contact magazine loader to said crimping tool; and (c) a magazine base plate with which said magazine is in removable engagement such that said magazine base plate and said magazine are prevented from rotating with respect to each other, said magazine base plate being rotatably attached to said main base plate.

19. A contact magazine loader as defined in claim 17 in which:

(a) said removable engagement is established between a detent groove in said magazine and one or more ball spring plungers positioned within said magazine base plate; and (b) a step detent interface exists between said magazine base plate and said main base plate for releasably biasing said magazine to remain at discrete rotational positions, said rotational positions each placing one of said channels into axial alignment with said crimping section.

20. A contact magazine loader for guiding the insertion of individual electrical contacts into a crimping section of a crimping tool, said contact magazine loader comprising:

(a) a magazine, said magazine being approximately cylindrical, and having a main axis and a plurality of channels being generally axially oriented and generally evenly dispersed around a radial periphery of said magazine, said magazine being adapted to be:

(i) placed in removable and rotatable engagement with said crimping tool such each of said channels are individually moveably into axial alignment with said crimping section by rotation of said magazine about said main axis; and (ii) preloadable with electrical contacts, wherein each such preloaded electrical contact is positioned within an insert casing, each said insert casing being adapted to being linearly slideably received in one of said channels; and (b) a trigger assembly including a hand trigger element, a pulled configuration and a returned configuration, said trigger assembly being operably associated with said magazine such that each time said trigger assembly is moved from said returned configuration to said pulled configuration, said magazine rotates to bring a subsequent one of said channels into axial alignment with said crimping section;

(c) a shuttle assembly having a shuttle element, an insert hook, a released configuration and a compressed configuration, said insert hook having an engagement configuration and being operably aligned with said magazine such that each time said insert hook is in said engagement configuration and said shuttle assembly is moved toward said compressed configuration, said insert hook moves one of said insert casings axially toward said crimping section, thereby placing any respective said preloaded electrical contact into said crimping section, said insert hook further having a lockback configuration, said insert hook being prevented from engaging one of said insert casings or inhibiting the axial movement of said magazine when in said lockback configuration;

(d) a main base plate disposed between said crimping tool and each of said magazine, trigger assembly, and shuttle assembly;

(e) a base plate adaptor being affixed to said main base plate and being adapted to clampingly engage a position adaptor of said crimping tool, thereby removably affixing said contact magazine loader to said crimping tool; and (f) a magazine base plate with which said magazine is in removable engagement such that said magazine base plate and said magazine are prevented from rotating with respect to each other, said magazine base plate being rotatably attached to said main base plate.

* * * * *